US011083941B2

(12) United States Patent
Jean et al.

(10) Patent No.: US 11,083,941 B2
(45) **Date of Patent: *Aug. 10, 2021**

(54) END CAP OF A HOCKEY STICK OR OTHER SPORTS IMPLEMENT

(71) Applicant: BAUER HOCKEY, LLC., Exeter, NH (US)

(72) Inventors: Philippe Jean, Terrebonne (CA); Charles Vaillancourt, Blainville (CA); Jean-Frederik Caron Kardos, Lorraine (CA)

(73) Assignee: BAUER HOCKEY LLC, Exeter, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/360,179

(22) Filed: Mar. 21, 2019

(65) Prior Publication Data

US 2019/0217169 A1 Jul. 18, 2019

Related U.S. Application Data

(63) Continuation of application No. 15/148,572, filed on May 6, 2016, now Pat. No. 10,279,235.

(51) Int. Cl.

| | |
|---|---|
| ***A63B 60/16*** | (2015.01) |
| ***A63B 59/70*** | (2015.01) |
| ***A63B 59/20*** | (2015.01) |
| ***A63B 71/00*** | (2006.01) |

(52) U.S. Cl.

CPC ..... *A63B 60/16* (2015.10); *A63B 59/20* (2015.10); *A63B 59/70* (2015.10); *A63B 71/0045* (2013.01)

(58) Field of Classification Search

CPC ..... A63B 60/16; A63B 59/20; A63B 59/70

See application file for complete search history.

(56) References Cited

U.S. PATENT DOCUMENTS

| | | | | |
|---|---|---|---|---|
| 5,172,508 | A * | 12/1992 | Schmidt | A01K 87/007 43/17.5 |
| 5,913,676 | A * | 6/1999 | Kim | A24F 13/26 431/253 |
| 6,113,508 | A * | 9/2000 | Locarno | A63B 59/70 473/516 |
| 10,279,235 | B2 | 5/2019 | Jean | |
| 2012/0046136 | A1 * | 2/2012 | Allen | A63B 60/24 473/563 |

(Continued)

FOREIGN PATENT DOCUMENTS

| | | |
|---|---|---|
| CA | 2929477 | 11/2017 |

OTHER PUBLICATIONS

Restriction Requirement dated Sep. 14, 2017 in connection with U.S. Appl. No. 15/148,572, 7 pages.

(Continued)

*Primary Examiner* — Jeffrey S Vanderveen

(57) ABSTRACT

A hockey stick or other sports implement for a player. The hockey stick or other sports implement comprises an elongated member to be held by the player and an end cap mounted to the elongated member. The end cap comprises an end portion comprising an end of the end cap that defines a longitudinal end of the elongated member, and a hanging portion comprising a hanger to hang the hockey stick or other sports implement. The hanger is adjustable.

33 Claims, 11 Drawing Sheets

(56) References Cited

U.S. PATENT DOCUMENTS

2017/0319922 A1 11/2017 Jean

OTHER PUBLICATIONS

Office Action dated Feb. 2, 2018 in connection with U.S. Appl. No. 15/148,572, 19 pages.
Final Office Action dated Nov. 5, 2018 in connection with U.S. Appl. No. 15/148,572, 20 pages.
Notice of Allowance dated Jan. 31, 2019 in connection with U.S. Appl. No. 15/148,572.

* cited by examiner

END CAP OF A HOCKEY STICK OR OTHER SPORTS IMPLEMENT

CROSS-REFERENCE TO RELATED APPLICATIONS

This application is a continuation of U.S. patent application Ser. No. 15/148,572 filed on May 6, 2016 and incorporated by reference herein.

FIELD

The invention relates to sports implements and, more particularly, to hockey sticks and other sports implements (e.g., lacrosse sticks).

BACKGROUND

Sports implements are used in various sports to strike, propel, or otherwise move a puck, ball, or other object.

For example, in hockey, a player uses a hockey stick to move, pass, and shoot a puck or ball during a game. Notably, the hockey stick comprises a shaft for holding by the player and a blade for handling the puck or ball. When not in use, it is generally desirable to have a manner in which to display and/or store the hockey stick. For instance, a retailer may wish to display a selection of hockey sticks at a point of sale (e.g., a store), or in some cases, the player may wish to display his/her hockey stick(s) at home.

A hockey stick's structure may not provide many options for displaying and/or storing thereof. For example, traditionally, retailers display their selection of hockey sticks on a rack on which the hockey sticks may be disposed vertically by standing each hockey stick on its blade, or in other cases, on a wall support on which the hockey sticks may be disposed horizontally and supported on their shafts. Other variations of display and storage solutions exist, but in general, they involve supporting the hockey stick on its shaft and/or its blade.

Similar issues often arise in other sports, such as lacrosse, in which players use sticks or other sports implements.

For these and other reasons, there is a need for improvements in hockey sticks and other sports implements.

SUMMARY

According to a first broad aspect, the invention provides a hockey stick. The hockey stick comprises a blade, a shaft to be held by a player, and an end cap mounted to the shaft. The end cap comprises an end portion comprising an end of the end cap that defines a longitudinal end of the hockey stick, and a hanging portion comprising a hanger to hang the hockey stick. The hanger is adjustable.

According to another broad aspect, the invention provides an end cap for a hockey stick. The hockey stick comprises a blade and a shaft to be held by a player. The end cap is mountable to the shaft and comprises an end portion comprising an end of the end cap to define a longitudinal end of the hockey stick, and a hanging portion comprising a hanger to hang the hockey stick. The hanger is adjustable.

According to another broad aspect, the invention provides a method of providing a hockey stick. The hockey stick comprises a blade, a shaft to be held by a player, and an end cap mounted to the shaft. The end cap comprises an end portion comprising an end of the end cap that defines a longitudinal end of the hockey stick. The end cap also comprises a hanging portion comprising a hanger to hang the hockey stick. The hanger is adjustable between a first state in which the hockey stick is hangable by the hanger and a second state in which the hockey stick is not hangable by the hanger. The method comprises causing the hanger to be in the first state and the hockey stick to be hung by the hanger and causing the hanger to be changed to the second state.

According to another broad aspect, the invention provides an end cap for a sports implement. The sports implement comprises an elongated member that comprises a handle to be held by a player. The end cap is mountable to the elongated member and comprises an end portion comprising an end of the end cap to define a longitudinal end of the sports implement, and a hanging portion comprising a hanger to hang the sports implement. The hanger is adjustable.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Figure 1A:
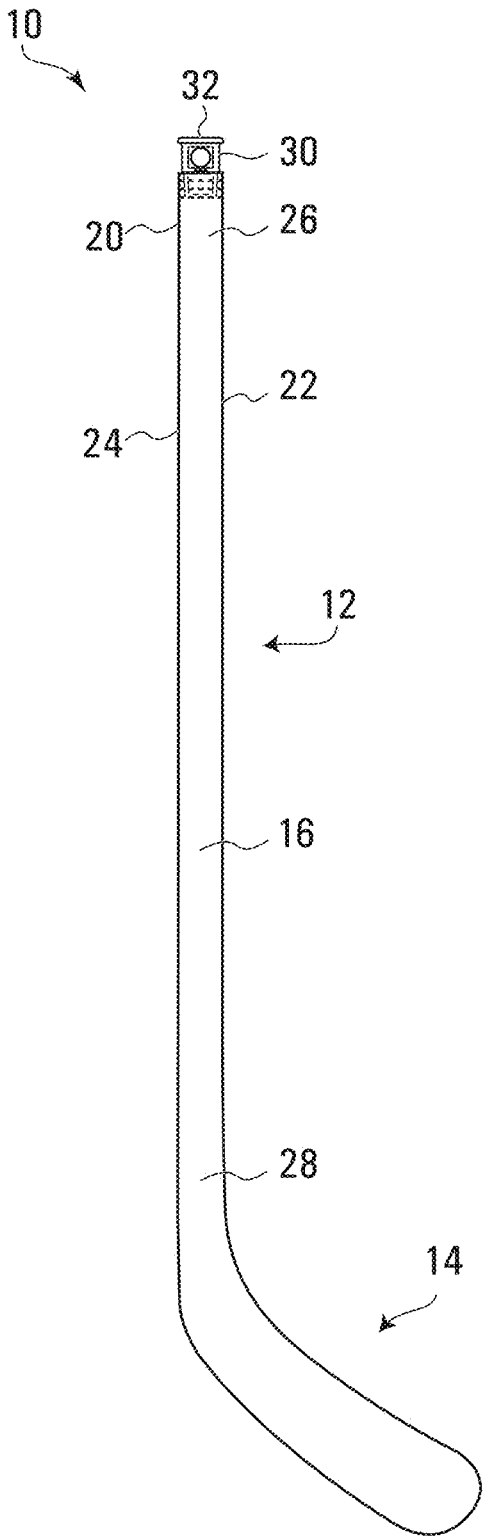
FIGS. 1A and 1B show an example of a sports implement in accordance with an embodiment of the invention, in which the sports implement is a hockey stick.
Figure 1B:
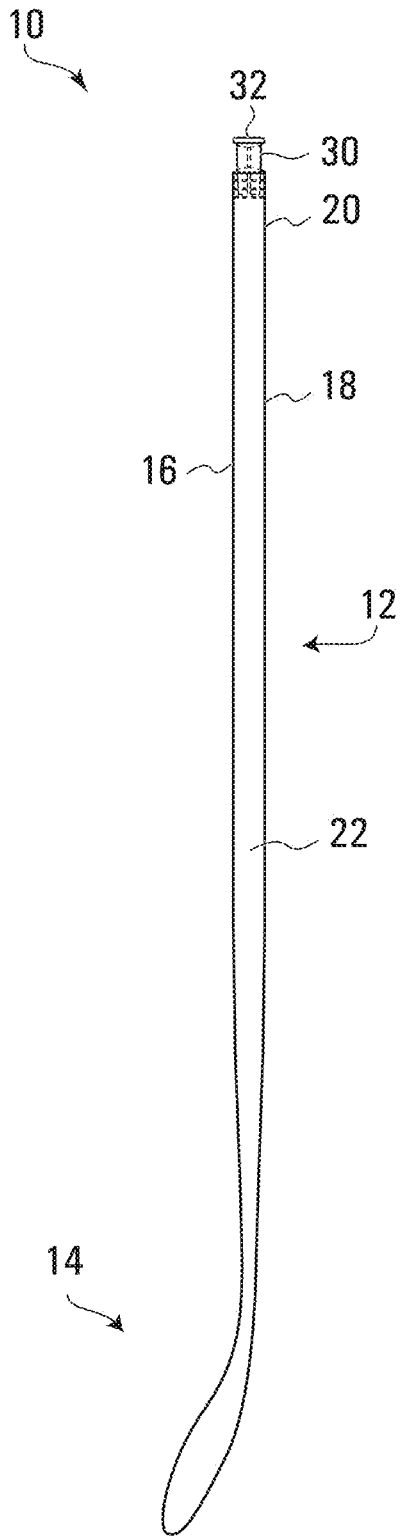

FIG. 1 shows an example of a sports implement 10 for use by a player playing a sport, in accordance with an embodiment of the invention. The sports implement 10 comprises an elongate member 12 configured to be held by the player and an object-contacting member 14 configured to contact an object (e.g., a puck or ball) intended to be moved in a game. In this embodiment, the sport is hockey and the sports implement 10 is a hockey stick for use by the player to pass, shoot or otherwise move a puck or ball. The elongate member 12 of the hockey stick 10 is a shaft, which comprises a handle 20 of the hockey stick 10, and the object-contacting member 14 of the hockey stick 10 is a blade.

In this example, the hockey stick 10 is a "mini" hockey stick, i.e., a miniaturized version of a hockey stick, which can be used by the player (e.g., a child or other individual) for playing "mini" hockey (e.g., with a miniaturized version of a hockey goal). In other examples, the hockey stick 10 may have a regular size (i.e., not be a mini hockey stick) to be used by the player to play regular hockey (e.g., ice hockey, roller hockey, or street hockey).

The hockey stick 10 comprises an end cap 30 defining a longitudinal end 32 of the hockey stick 10, which can sometimes be referred to as a "butt end" of the hockey stick 10. In this embodiment, the end cap 30 is provided to aesthetically complete the hockey stick 10 and to enhance use of the hockey stick 10, such as by protecting the player and/or helping the player manipulate the hockey stick 10 when playing. In addition, in this embodiment, as further discussed below, the end cap 30 allows the hockey stick 10 to be hung, such as at a point of sale (e.g., a store) or another location where the hockey stick 10 may be displayed.

Figure 2:
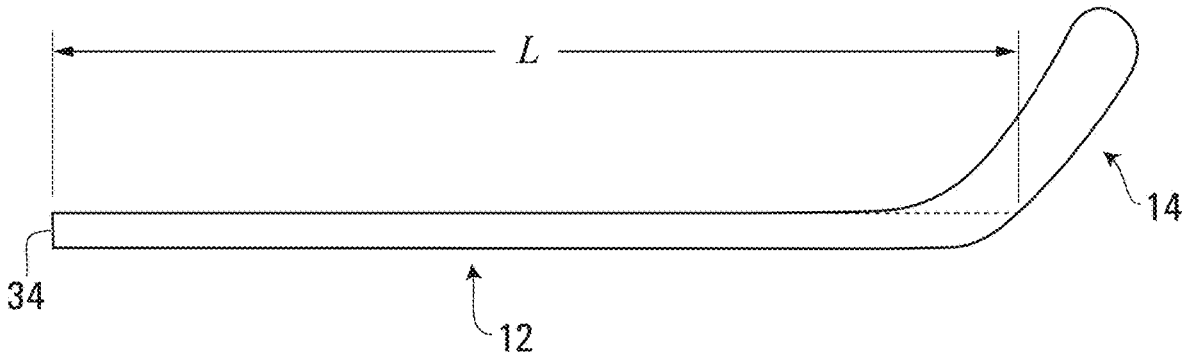
FIG. 2 is a side elevation view of the hockey stick.

The shaft 12 is configured to be held by the player to use the hockey stick 10. The shaft 12 includes a front surface 16 and a rear surface 18 opposite one another, as well as a top surface 22 and a bottom surface 24 opposite one another. Longitudinal proximal and distal end portions 26, 28 of the shaft 12 are respectively adjacent to the handle 20 and the blade 14 and define a length of the shaft 12. A length L of the hockey stick 10 is measured from a proximal end 34 of the shaft 12 along the top surface 22 of the shaft 12 through the blade 14, as shown in FIG. 2. For example, in some embodiments, since the hockey stick 10 is a mini hockey stick in this example, the length L of the hockey stick 10 may be no more than 30 inches, in some cases no more than 25 inches, in some cases no more than 20 inches, in some cases no more than 18 inches, and in some cases no more than 16 inches, and in some cases even less.

Figure 3:
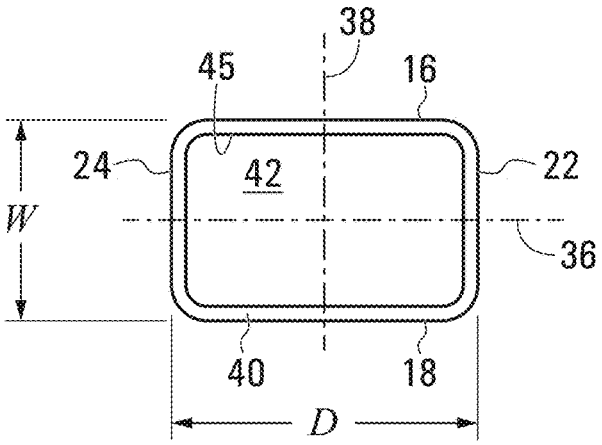
FIG. 3 is a cross-sectional view of a shaft of the hockey stick taken along line 3-3 of FIG. 2.

A cross-section of the shaft 16 may have any suitable configuration. For instance, in this embodiment, with additional reference to FIG. 3, the cross-section of the shaft 12 has a major axis 36 which defines a major dimension D of the shaft's cross-section and a minor axis 38 which defines a minor dimension W of the shaft's cross-section. In this example, the cross-section of the shaft 12 is generally polygonal. More particularly, in this example, the cross-section of the shaft 12 is generally rectangular, with the front surface 16, the rear surface 18, the top surface 22, and the bottom surface 24 being generally flat. Corners between these surfaces of the shaft 12 may be rounded corners.

In this embodiment, the shaft 12 is a composite shaft. That is, the shaft 12 is at least mainly (i.e., mainly or entirely) made of composite material. For example, in this embodiment, the shaft 12 comprises a wall 40 made of the composite material and forming a cavity 42 which extends along at least part, in this case all, of its length. The cavity defines an internal surface 45 of the shaft 12. The cavity 42 may be hollow or may contain a filler (e.g., foam). For instance, the shaft 12 may be a fiber-matrix composite shaft comprising fibers disposed within a hardened resin matrix. The fibers may be aligned and oriented in defined directions with an outer layer often being a woven fiber. Various fibers may be employed including carbon, aramid, boron, glass, etc. The shaft 12 may have aligned layers of fibers and a woven outer layer. The shaft 12 may be formed by wrapping plies over a mandrel and then curing or by overlaying fibers around a mandrel that is then fed into a heating element to cure the resin.

The shaft 12 may have any other suitable shape and/or be constructed in any other suitable way in other embodiments. For example, in some embodiments, the cross-section of the shaft 12 may have any other suitable configuration (e.g., the front surface 16, the rear surface 18, the top surface 22, and/or the bottom surface 24 may be curved and/or angular and/or have any other suitable shape) and/or may vary along the length of the shaft 12. As another example, in some embodiments, the shaft 12 may comprise wood, aluminum or any other suitable material (e.g., the shaft 12 may be a metallic shaft made of aluminum or other suitable metal, may be made of a combination of metal and fiber composite, or may be a wooden shaft).

Figure 4:
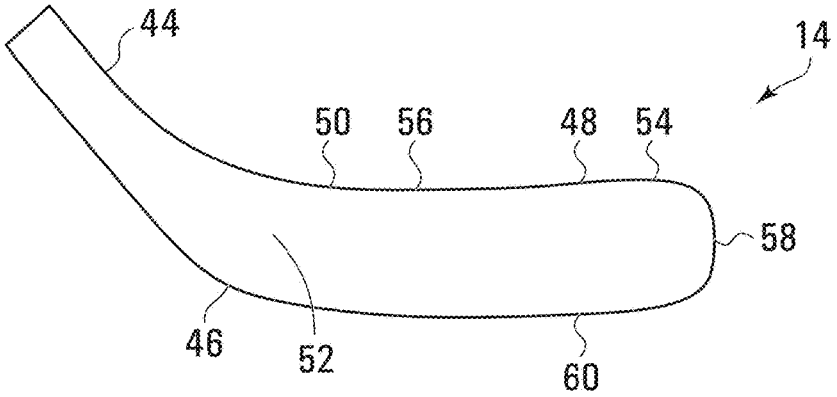
FIG. 4 is a side elevation view of a blade of the hockey stick.

The blade 14 is configured to allow the player to pass, shoot or otherwise move the puck or ball. With additional reference to FIG. 4, in this embodiment, the blade 14 comprises a shank 44, a heel 46 and a blade element 48. The heel 46 is located at a junction of the shank 44 and the blade element 48. The shank 44 interfaces with the shaft 12. In some embodiments where the blade 14 is adapted to be inserted into a hollow space of the shaft 12 (e.g., the cavity 42), the shank 44 may comprise a tenon for insertion in that hollow space. A periphery 50 of the blade 14 comprises a front surface 52 and a rear surface 54 opposite one another, as well as a top edge 56, a tip edge 58 and a bottom edge 60.

Figure 5:
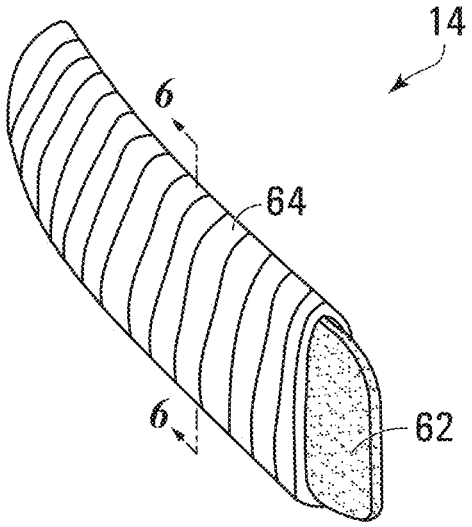
FIG. 5 shows an example of a construction of the blade.
Figure 6:
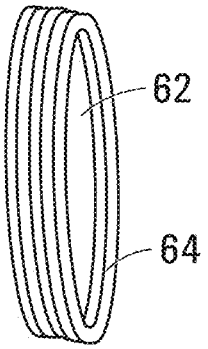
FIG. 6 shows a cross-sectional view of the blade of FIG. 5.
Figure 7:
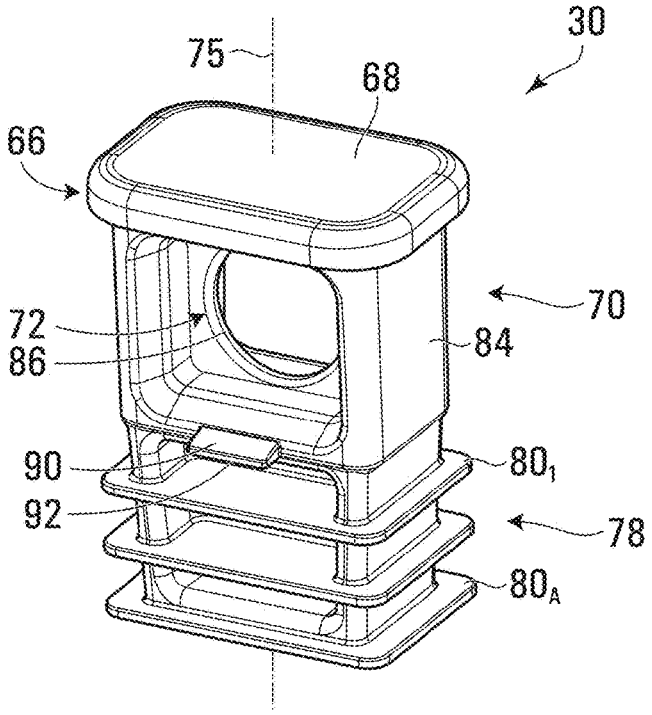
FIG. 7 is a perspective view of an end cap of the hockey stick.
Figure 8:
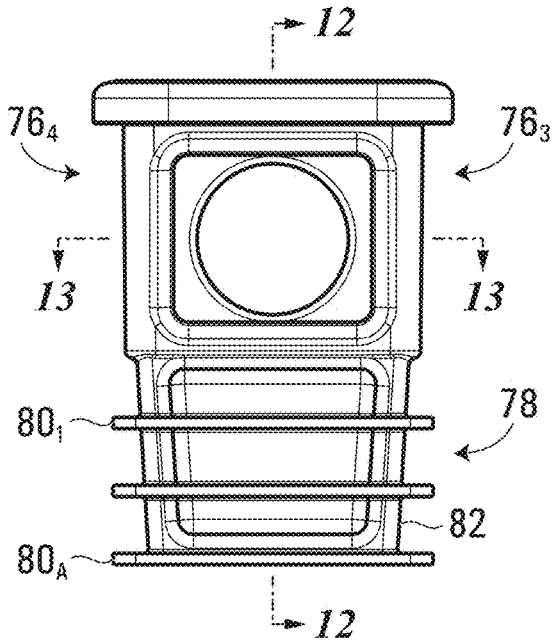
FIGS. 8 to 11 are respective front, side, top and rear views of the end cap of FIG. 7.
Figure 9:
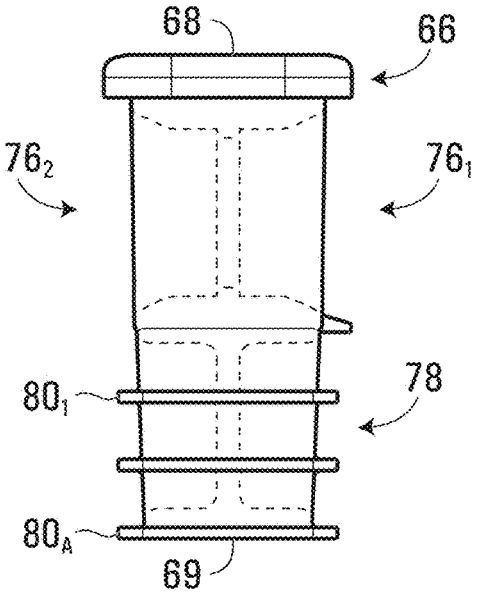
Figure 10:
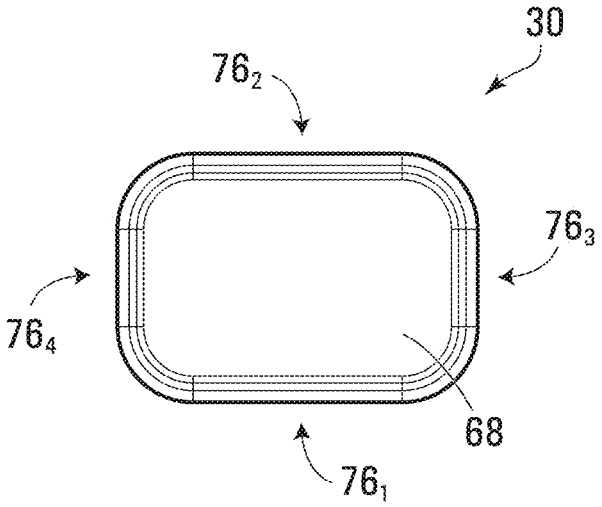
Figure 11:
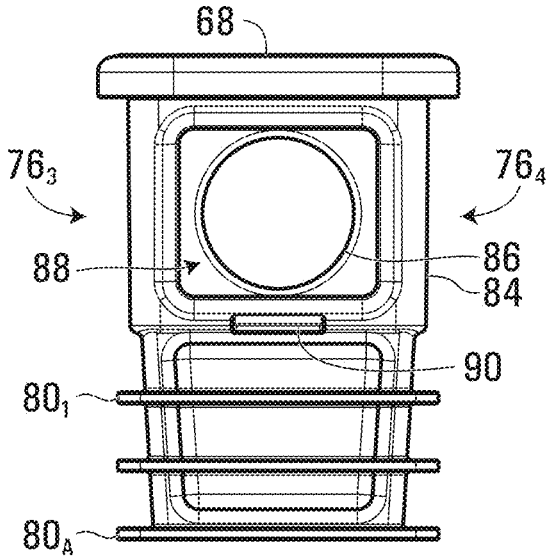
Figure 12:
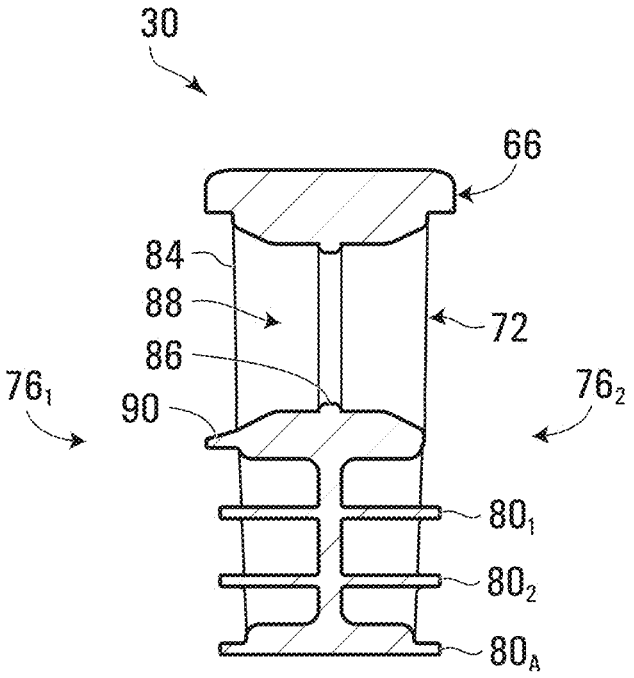
FIG. 12 is a cross-sectional view of the end cap taken along line 12-12 of FIG. 8.
Figure 13:
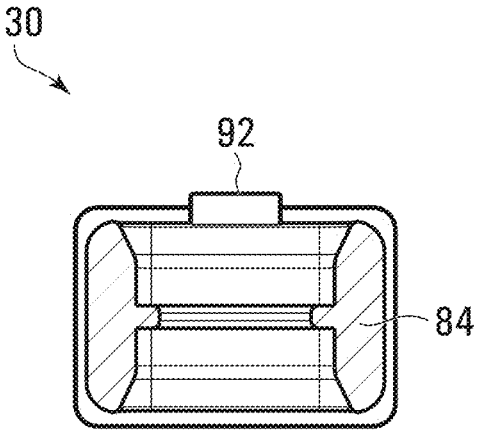
FIG. 13 is a cross-sectional view of the end cap taken along line 13-13 of FIG. 8.
Figure 14:
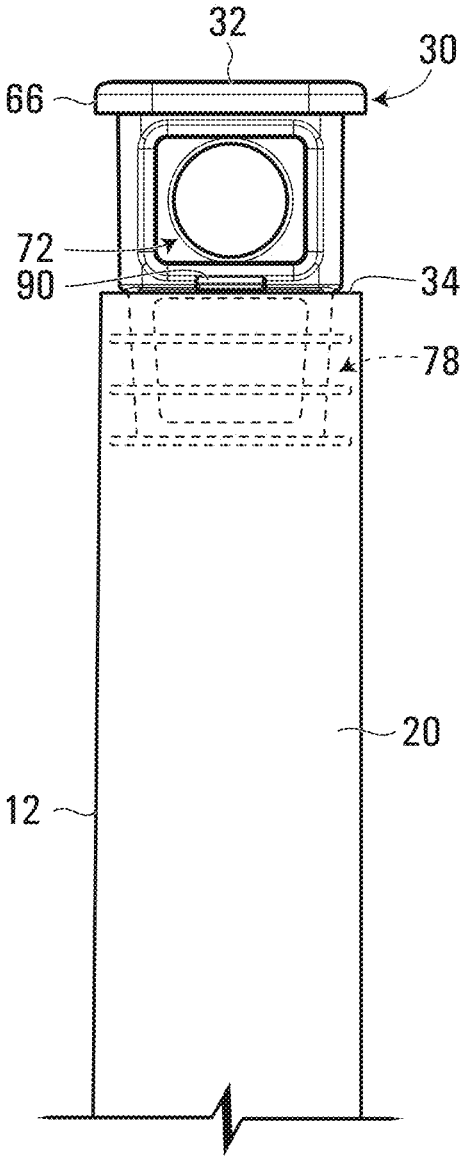
FIG. 14 shows the end cap in engagement with the shaft of the hockey stick when a hanger of a hanging portion of the end cap is in its hanging state such that the hockey stick is hangable by the hanger.
Figure 15:
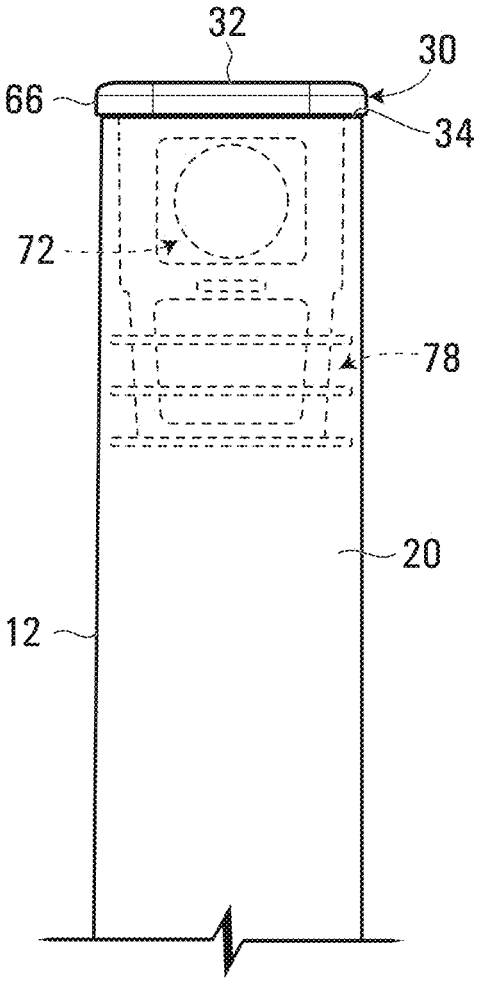
FIG. 15 shows the end cap in engagement with the shaft of the hockey stick when the hanger of the hanging portion of the end cap is in its non-hanging state such that the hockey stick is not hangable by the hanger.

In this embodiment, with additional reference to FIGS. 5 and 6, the blade 14 comprises a foam core 62 wrapped with one or more layers of fiber material 64. The foam core 62 may include one or more foam materials (e.g., polyurethane foam, etc.). The layers of fiber material 64 may include fibers (e.g., glass fibers, carbon fibers, aramid fibers, etc.) that may have been preimpregnated with resin to be taped on the foam core 62 during manufacturing. In some embodiments, the layers of fiber material 64 may be stitched to the foam core 62 during manufacturing.

The blade 14 may have any other suitable shape and/or be constructed in any other suitable way in other embodiments. For example, in some embodiments, the blade 14 may comprise a wooden core. Also, the blade 14 may be a replaceable component of the hockey stick 10 and thus removable from the shaft 12.

The end cap 30 is mountable to the shaft 12 adjacent to the handle 20 to define the longitudinal end 32 of the hockey stick 10. In this embodiment, the end cap 30 forms an enlargement that is larger than the cross-section of the shaft 12 at the handle 20. This may be useful, for instance, to help the player pick up the hockey stick 10 when it is dropped. Also, in this embodiment, the end cap 30 is removably mountable to the shaft 12 such that it can be mounted and removed from the shaft 12 as desired.

With additional reference to FIGS. 7 to 13, the end cap 30 comprises an end portion 66 comprising an end 68 of the end cap 30 that defines the longitudinal end 32 of the hockey stick 10 and a hanging portion 70 comprising a hanger 72 to hang the hockey stick. The hockey stick 10 may be hung by the hanger 72 on a support 74, which may comprise a hook, a bar, a pin, or any other device on which the hockey stick 10 can be hung.

The hanger 72 is adjustable. That is, the hanger 72 is changeable in state, i.e., in position, configuration, and/or one or more other aspects. Notably, in this embodiment, the hanger 72 can be adjusted depending on whether the hockey stick 10 is to be hung on the support 74 or used to play.

The end cap 30 extends from the end 68, which is a first end, to a second end 69 along a longitudinal axis 75 which defines a longitudinal direction of the end cap 30. The end portion 66 of the end cap 30 is configured to be precluded from being inserted into a hollow space of the shaft 12 adjacent to the handle 20 (e.g., the cavity 42). To that end, the end portion 66 has cross-sectional dimensions that are larger than the cross-sectional dimensions of the shaft 12. More particularly, a cross-section of the end portion 66 normal to the longitudinal direction of the end cap 30 is larger than a cross-section of the shaft 12 normal to the longitudinal direction of the shaft 12. In this embodiment, the end cap 30 has a plurality of lateral sides $76_1$, $76_2$, $76_3$, $76_4$, including a first lateral side $76_1$ opposite to a second lateral side $76_2$, and a third lateral side $76_3$ opposite to a fourth lateral side $76_4$. In use, the first and second lateral sides $76_1$, $76_2$ of the end cap 30 face the front and rear surfaces 16, 18 of the shaft 12 respectively while the third and fourth lateral sides $76_3$, $76_4$ of the end cap 30 face the top and bottom surfaces 22, 24 of the shaft 12 respectively.

In this embodiment, the end cap 30 is generally rectangular and thus has four lateral sides. However, in other embodiments, for example where the shaft 12 may have more or less than four lateral sides (e.g., in cases where the shaft has a hexagonal cross-section), the end cap 30 may have more or fewer lateral sides in order to match the sides of the shaft 12.

Also, in this embodiment, contrary to the end portion 66, the hanging portion 70 of the end cap 30 is configured to be inserted into the cavity 42 of the shaft 12. To that end, the cross-sectional dimensions of the hanging portion 70 are made smaller than the cross-sectional dimensions of the end portion 66. More particularly, the cross-section of the end portion 66 of the end cap 30 normal to the longitudinal direction of the end cap 30 is larger than a cross-section of the hanging portion 70 normal to the longitudinal direction of the end cap 30.

The hanging portion 70 comprises an attachment 78 defining the second end 69 of the end cap 30. In this embodiment, the attachment 78 is such that it fits tightly into the cavity 42 of the shaft 12 to prevent the end cap 30 from being accidentally removed from the hockey stick 10 when used by the player. As such, the attachment 78 is configured to engage the internal surface 45 of the shaft 12. More particularly, in this embodiment, the attachment 78 is configured to engage the internal surface 45 of the shaft 12 via a press-fit. In other words, the attachment 78 is a "press-fit" attachment that engages the internal surface 45 of the shaft 12 by a press-fit of the hanging portion 70 in the cavity 42 of the shaft 12. As such, the attachment 78 frictionally engages the internal surface 45 of the shaft 12. To that end, in this embodiment, the attachment 78 comprises a plurality of attachment members $80_1$-$80_A$ that are spaced apart from one another in the longitudinal direction of the end cap 30. Each attachment member $80_i$ engages the internal surface 45 of the shaft 12. The attachment 78 comprises a core 82 from which the attachment members $80_1$-$80_A$ project outwardly (in use, towards the internal surface 45 of the shaft 12). In this embodiment, a cross-section of the core 82 normal to the longitudinal direction of the end cap 30 varies in size in the longitudinal direction of the end cap 30. More specifically, in this example of implementation, the core 82 tapers in the longitudinal direction of the end cap 30 away from the end portion 66 of the end cap 30.

In this embodiment, the hanger 72 of the hanging portion 70 comprises a body portion 84 and an opening 86 in the body portion 84 for receiving the support 74 for the hockey stick 10. More specifically, in this example of implementation, the opening 86 is disposed in a recess 88 in the body portion 84 and extends from the first lateral side $76_1$ to the second lateral side $76_2$ of the end cap 30. The opening 86 may extend from the third lateral side $76_3$ to the fourth lateral side $76_4$ of the end cap 30 in other embodiments.

In this example of implementation, the hanger 72 is adjustable between a "hanging state" in which the hockey stick 10 is hangable by the hanger 72 (e.g., on the support 74) and a "non-hanging state" in which the hockey stick 10 is not hangable by the hanger 72. Thus, the hanging state of the hanger 72 is for displaying the hockey stick 10 while the non-hanging state of the hanger 72 is for using the hockey stick 10 to play hockey.

In this embodiment, the hanger 72 is adjustable such that the hanger 72 is movable relative to the shaft 12. That is, a position of the hanger 72 relative to the shaft 12 is different in the hanging state of the hanger 72 and in the non-hanging state of the hanger 72. In particular, the hanger 72 is movable relative to the shaft 12 between a hanging position in which the hockey stick 10 is hangable by the hanger 72 and a non-hanging position in which the hockey stick 10 is not hangable by the hanger 72.

In the hanging position, the hanger 72 is exposed such that the hanger 72 is accessible. In the non-hanging position, the hanger 72 is concealed such that the hanger 72 is inaccessible. More specifically, in the non-hanging position, the hanger 72 extends deeper into the cavity 42 of the shaft 12 than when the hanger 72 is in the hanging position.

The hanging portion 70 further comprises a retainer 90 to retain the hanger 72 relative to the shaft 12 to allow the hanger 72 to hang the hockey stick 10. More specifically, the retainer 90 retains the hanger 72 in the hanging position such that the hanger 72 is exposed and accessible. To that end, the retainer 90 is configured to engage a longitudinal end of the shaft 12, notably the proximal end 34, to resist insertion of the hanging portion 70 of the end cap 30 into the cavity 42 of the shaft 12 beyond the retainer 90. In this example of implementation, the retainer 90 comprises a retaining projection 92 projecting transversally to the longitudinal direction of the end cap 30. In this embodiment, the retaining projection 92 extends on the first lateral side $76_1$ of the end cap 30. That is, the retaining projection 92 extends on a single one of the lateral sides $76_1$, $76_2$, $76_3$, $76_4$ of the end cap 30. In other embodiments, the retaining projection 92 may extend on more than one of the lateral sides $76_1$, $76_2$, $76_3$, $76_4$ of the end cap 30.

The retainer 90 is deformable to adjust the hanger 72. In particular, the retainer 90 is deformable such that it deforms when an increased load is applied on the end cap 30 to insert the end cap 30 into the cavity 42 of the shaft 12 beyond the retainer 90. That is, the retainer 90 resists insertion of the hanging portion 70 of the end cap 30 into the cavity 42 of the shaft 12 as long as a load applied on the end cap 30 to insert the end cap 30 into the cavity 42 is smaller than an insertion load $F_{IN}$. Once the load applied on the end cap 30 to further insert the end cap 30 into the cavity 42 is equal to or greater than the insertion load $F_{IN}$, the retainer 90 deforms thus allowing further insertion of the end cap 30 into the cavity 42 of the shaft 12 to move the hanger 72 into its non-hanging position. As such, the retainer 90 is deformable to move the hanger 72 between the hanging position and the non-hanging position.

In this embodiment, the end cap 30 comprises an elastomeric material. For instance, in this example, the end cap 30 comprises rubber. In other embodiments, the end cap 30 may be made from any other suitable material.

Also, in this embodiment, the end cap 30 is a one-piece end cap. That is, an entirety of the end cap 30 is integrally made and thus constitutes a single component. More specifically, in this embodiment, the end cap 30 is molded to constitute a molded one-piece end cap. In this example of implementation, the end cap 30 is injection molded. The end cap 30 may be molded in any other suitable way.

Thus, the hockey player or retailer wishing to display and/or store the hockey stick 10 causes the hanger 72 to be in its hanging state such as to hang the hockey stick 10 by the hanger 72 (e.g., via the support 74). At a point of sale, this may be useful to hang multiple hockey sticks on a single support 74. Once it is no longer desired to hang the hockey stick 10 by the hanger 72, the hockey player or retailer causes the hanger 72 to be changed to its non-hanging state. For example, an instruction is provided to change the hanger 72 to its non-hanging state once the hockey stick 10 is removed from the support 74 at the point of sale of the hockey stick 10.

The hockey stick 10 may be constructed in various other ways in other embodiments.

Figure 16:
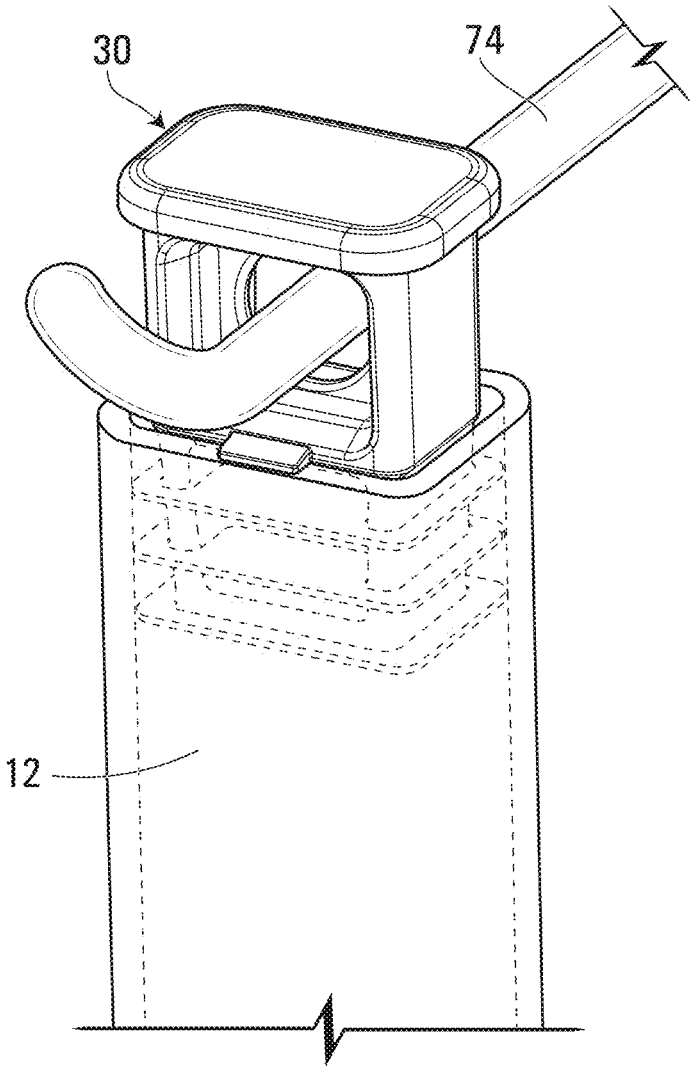
FIG. 16 shows the hockey stick being hung by the hanger of the hanging portion of the end cap on a support.
Figure 17:
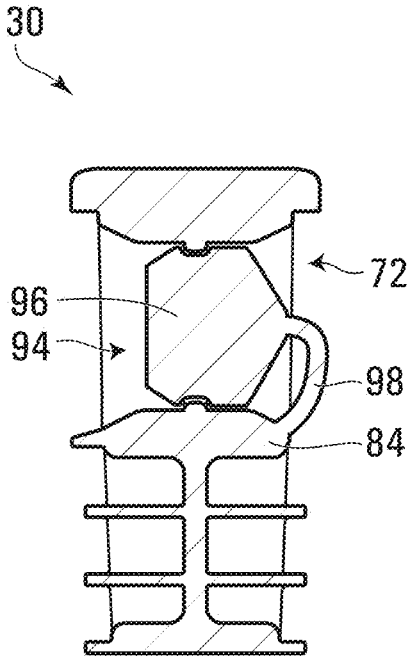
FIG. 17 is a cross-sectional view of the end cap in an example of a variant in which the hanger of the hanging portion of the end cap can be adjusted from its hanging state to its non-hanging state without change the position of the hanger.

For instance, in a variant, the hanger 72 can be adjusted from its hanging state to its non-hanging state without changing the position of the hanger 72. For example, as shown in FIG. 16, the hanger 72 may comprise an adjustment mechanism 94 for adjusting the hanger 72 from its hanging state to its non-hanging state. In these cases, the retainer 90 of the hanging portion 70 abuts the longitudinal end 34 of the shaft 12 to preclude insertion of the end cap 30 into the cavity 42 of the shaft 12 beyond the retainer 90 (e.g., the retainer 90 may not be deformable and/or is dimensioned to prevent insertion of the end cap 30 into the cavity 42 beyond the retainer 90). In this example of implementation, the adjustment mechanism 94 comprises a filling member 96 configured for filling the opening 86 of the hanger 72. In the hanging state of the hanger 72, the opening 86 is unfilled such that the hockey stick 10 can be hanged by the hanger 72. In the non-hanging state of the hanger 72, the opening 86 of the hanger 72 is filled by the filling member 96 such that the hockey stick 10 is not hangable by the hanger 72. It is noted that in this variant, the hanger 72 is exposed both in the hanging state and in the non-hanging state of the hanger 72.

In this specific example of implementation, the filling member 96 of the adjustment mechanism 94 is integrally made with the end cap 30. That is, the filling member 96 of the adjustment mechanism 94 and the end cap 30 are a one-piece component. For instance, the filling member 96 may be connected to the remainder of the end cap 30 (e.g., to the body portion 84 of the hanger 72) by an arm 98.

In another variant, the end cap 30 may not be removable from the hockey stick 10. That is, in some embodiments, the end cap 30 may be a permanent component of the hockey stick 10.

In another variant, the end cap 30 may comprise components that are movable relative to one another and interact to allow the end cap 30 to be hangable and non-hangable.

Figure 18:
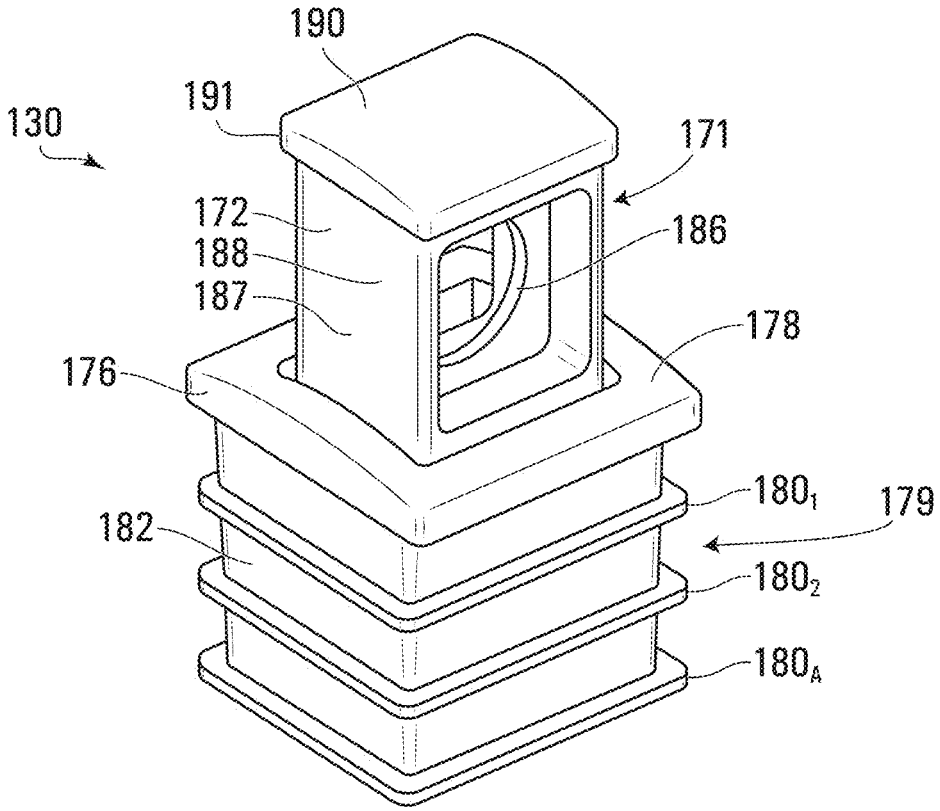
FIG. 18 is a perspective view of an end cap in accordance with a variant in which the end cap comprises a hanging portion and an attachment that are separate from one another.
Figure 19:
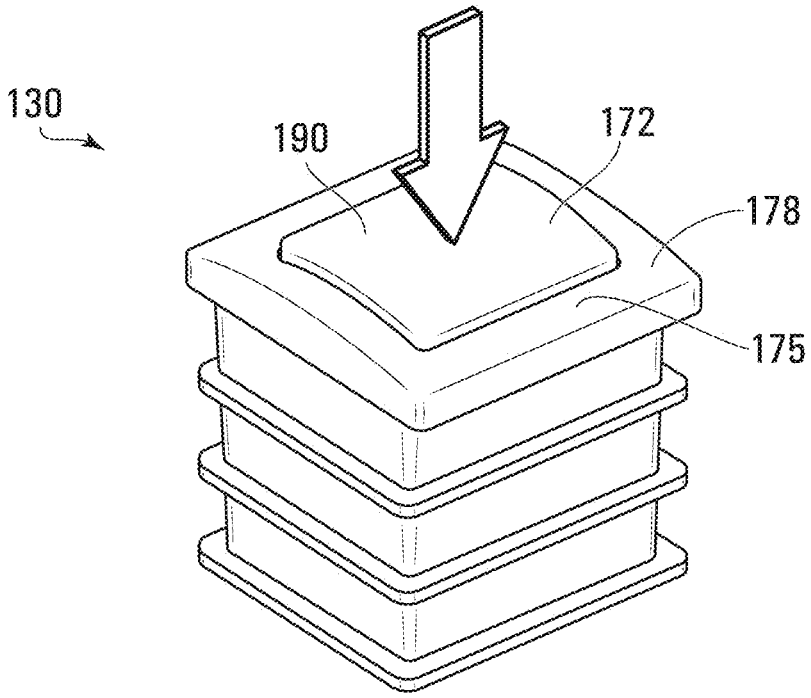
FIG. 19 shows the end cap of FIG. 18 when a hanger of the hanging portion is in in its non-hanging state such that the hockey stick is not hangable by the hanger.
Figure 20:
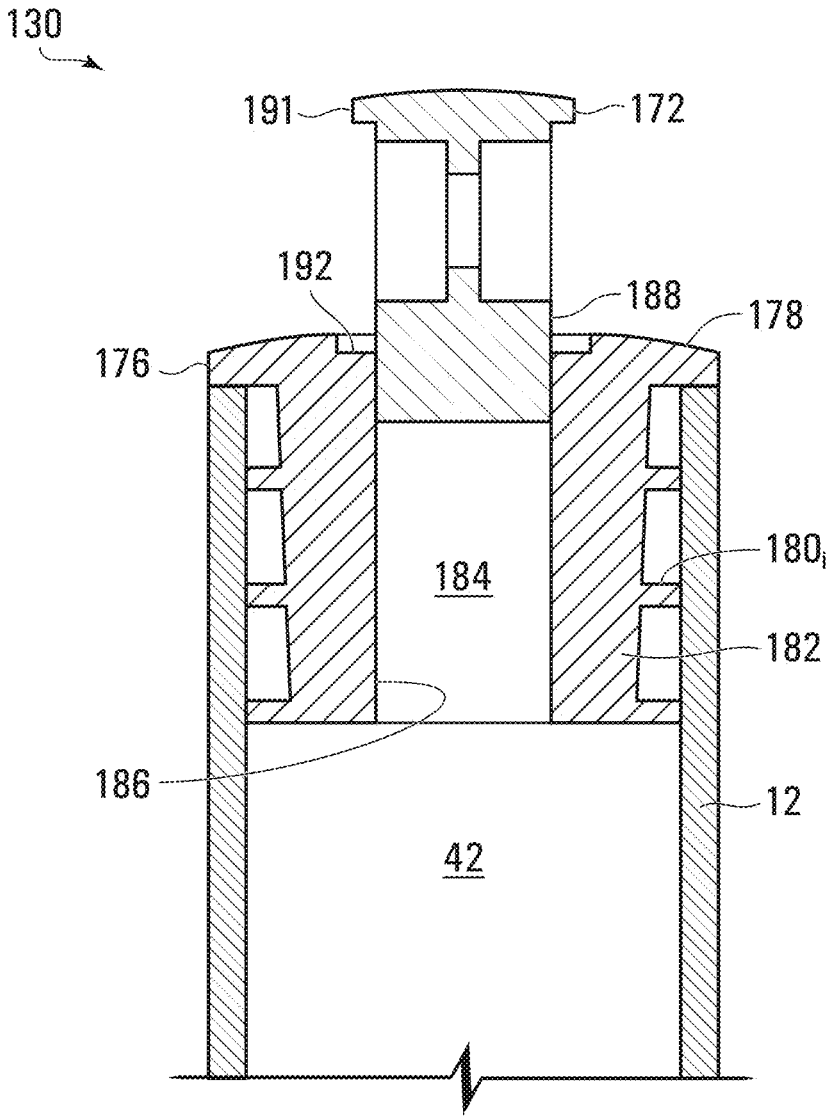
FIG. 20 shows a cross-section of the end cap of FIG. 18 as it is engaged in the hockey stick when the hanger is in its hanging state such that the hockey stick is hangable by the hanger.

For instance, FIGS. 18 to 20 show an end cap 130 that is similar to the end cap 30 but functions differently. The end cap 130 comprises a hanging portion 171 and a base 178 that are separate from one another. The base 178 is such that it fits tightly into the cavity 42 of the shaft 12 to prevent the end cap 130 from being accidentally removed from the hockey stick 10 when used by the player. As such, the base 178 is configured to engage the internal surface 45 of the shaft 12. To that end, the base 178 comprises an attachment portion 179 configured in a similar manner to the attachment 78 described above in respect of the end cap 30. Notably, in this example of implementation, the attachment portion 179 of the base 178 comprises a plurality of attachment members $\mathbf{180}_1$-$\mathbf{180}_A$ that are spaced apart from one another in a longitudinal direction of the end cap 130. Each attachment member $\mathbf{180}_i$; engages the internal surface 45 of the shaft 12. The attachment portion 179 also comprises a core 182 from which the attachment members $\mathbf{180}_1$-$\mathbf{180}_A$ project outwardly (in use, towards the internal surface 45 of the shaft 12). The core 182 is similar to the core 82 described above.

In this example, the base 178 also comprises an end portion 176 that is enlarged relative to the core 182 and the attachment members $\mathbf{180}_1$-$\mathbf{180}_A$. More specifically, the end portion 176 is sized such that it abuts the longitudinal end 34 of the shaft 12 to preclude insertion of the base 178 into the cavity 42 of the shaft 12 beyond the end portion 176.

The hanging portion 171 comprises a hanger 172 that is configured similarly to the hanger 72 described above in many respects, notably comprising a body portion 187 and an opening 186 in the body portion 187 for receiving the support 74 for the hockey stick 10. The hanger 172 also comprises an end portion 190 that defines the longitudinal end 32 of the hockey stick 10. The hanger 172 is adjustable between a hanging state in which the hockey stick 10 is hangable by the hanger 172 and a non-hanging state in which the hockey stick 10 is not hangable by the hanger 172. The hanging state of the hanger 172 is for displaying the hockey stick 10 while the non-hanging state of the hanger 172 is for using the hockey stick 10 to play hockey.

The hanger 172 is movable relative to the base 178 in the longitudinal direction of the end cap 130 to be adjusted. Thus, a position of the hanger 172 relative to the base 178 is different in the hanging state of the hanger 172 and in the non-hanging state of the hanger 172. In particular, the hanger 172 is movable relative to the base 178 between a hanging position in which the hockey stick 10 is hangable by the hanger 172 and a non-hanging position in which the hockey stick 10 is not hangable by the hanger 172. To that end, the hanger 172 is disposed in a cavity 184 of the base 178 that extends in the longitudinal direction of the end cap 130. The cavity 184 is defined by an inner surface 186 of the base 178 and, in this example, traverses an entirety of the base 178, including the core 182 and the end portion 176 thereof. In the hanging position, as shown in FIGS. 18 and 20, the hanger 172 is exposed such that the hanger 172 is accessible. In the non-hanging position, as shown in FIG. 19, the hanger 172 is concealed such that the hanger 172 is inaccessible. More specifically, the hanger 72 extends deeper into the cavity 184 of the base 178 when in the non-hanging position than when in the hanging position.

The hanger 172 is configured to be retained in the cavity 184 of the base 178 such as to resist movement of the hanger 172 relative to the base 178. For instance, the body 187 of the hanger 172 comprises an exterior peripheral surface 188 that engages the inner surface 186 of the base 178 such that a frictional engagement between the exterior peripheral surface 188 of the body 187 of the hanger 172 and the inner surface 186 of the base 178 retains the hanger 172 in the cavity 184 of the base 178.

In this embodiment, the hanger 172 is movable relative to the base 178 by applying an insertion force on the end portion 190 of the hanger 172, as shown in FIG. 19. The insertion force that is applied to move the hanger 172 relative to the base 178 must be sufficient to overcome a frictional force generated between the external peripheral surface 188 of the body 187 of the hanger 172 and the inner surface 186 of the base 178. Thus, by applying the insertion force, the hanger 172 can be pushed further into engagement with the base 178. Alternatively, the hanger 172 can be pulled away from the base 178 by applying a pulling force that will overcome the frictional force generated between the external peripheral surface 188 of the body 187 of the hanger 172 and the inner surface 186 of the base 178. The resistance to movement of the hanger 172 relative to the base 178 provided by the interaction between the surfaces 186, 188 may prevent removal of the hanger 172 from the base 178 or may make it sufficiently difficult to remove such as to prevent accidental removal of the hanger 172 from the base 178.

In this example of implementation, the hanger 172 is also configured to be prevented from entering too far into the cavity 184 of the base 178. To that end, the hanger 172 comprises a protrusion 191 at the end portion 190 of the hanger 172. The protrusion 191 is configured to engage the base 178 such as to prevent insertion of the hanger 172 into the cavity 184 beyond the protrusion 191. This may be achieved by sizing the protrusion 191 such that it does not fit within the cavity 184 of the base 178. Furthermore, in this example, the protrusion 191 is configured to engage a recess 192 of the base 178 that is sized such as to receive the protrusion 191. Thus at least a portion of the protrusion 191 is received within the recess 192. In some cases, this may allow the end portion 190 of the hanger 172 to be flush with a top surface 175 of the base 178 when the hanger 172 is in its non-hanging position.

Although in this embodiment the sports implement 10 is a hockey stick, in other embodiments, the sports implement 10 may be any other implement used for striking, propelling or otherwise moving an object in a game of another sport. For example, in other embodiments, the sports implement 10 may be a lacrosse stick for a lacrosse player, in which the object-contacting member 14 of the lacrosse stick 10 comprises a lacrosse head for carrying, shooting and passing a lacrosse ball.

Any feature of any embodiment described herein may be combined with any feature of any other embodiment described herein in some examples of implementation.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

In describing embodiments above, terminology is resorted to for the sake of clarity but the invention is not intended to be limited to specific terms used, and it is understood that each specific term comprises all equivalents.

Unless otherwise indicated, the drawings are intended to be read together with the specification and are to be considered a portion of the entire written description of the invention. As used in the preceding description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A hockey stick comprising:

a blade;

a shaft to be held by a player; and a hanger configured to hang the hockey stick, the hanger being adjustable to change between a hanging state for hanging the hockey stick and a non-hanging state for using the hockey stick, at least part of the hanger being movable relative to the shaft to change the hanger between the hanging state and the non-hanging state.

2. The hockey stick of claim 1, wherein the hockey stick is hangable by the hanger in the first state and the hockey stick is not hangable by the hanger in the second state.

3. The hockey stick of claim 2, wherein the first state of the hanger is for displaying the hockey stick.

4. The hockey stick of claim 1, wherein the hanger is adjustable such that the hanger is movable relative to the shaft between the first state and the second state.

5. The hockey stick of claim 4, wherein the hanger is movable relative to the shaft between a first position corresponding to the first state in which the hockey stick is hangable by the hanger and a second position corresponding to the second state in which the hockey stick is not hangable by the hanger.

6. The hockey stick of claim 5, wherein the hanger is exposed in the first position and concealed in the second position.

7. The hockey stick of claim 1, wherein the hanger comprises an opening to receive a support for the hockey stick.

8. The hockey stick of claim 7, wherein the hanger comprises a recess and the opening is disposed in the recess.

9. The hockey stick of claim 1, wherein the shaft comprises a cavity and the hockey stick comprises an end cap mounted to the shaft, the end cap comprising:

an end portion comprising an end of the end cap that defines a longitudinal end of the hockey stick; and a hanging portion comprising the hanger and inserted in the cavity.

10. The hockey stick of claim 9, wherein the hanging portion comprises a retainer to retain the hanger relative to the shaft to allow the hanger to hang the hockey stick.

11. The hockey stick of claim 10, wherein the retainer is configured to engage a longitudinal end of the shaft.

12. The hockey stick of claim 10, wherein the retainer comprises a retaining projection projecting transversally to a longitudinal direction of the end cap.

13. The hockey stick of claim 12, wherein the retaining projection extends on fewer than all of a plurality of lateral sides of the end cap.

14. The hockey stick of claim 13, wherein the retaining projection extends on a single one of the lateral sides of the end cap.

15. The hockey stick of claim 10, wherein the retainer is deformable to adjust the hanger.

16. The hockey stick of claim 9, wherein the hanging portion extends deeper into the cavity when the hanger is in the second state than when the hanger is in the first state.

17. The hockey stick of claim 9, wherein the shaft comprises an internal surface defining the cavity and the hanging portion comprises an attachment engaging the internal surface.

18. The hockey stick of claim 17, wherein the attachment is a frictional attachment that frictionally engages the internal surface.

19. The hockey stick of claim 17, wherein the attachment comprises a plurality of attachment members spaced apart from one another.

20. The hockey stick of claim 19, wherein respective ones of the attachment members are spaced apart from one another in a longitudinal direction of the end cap.

21. The hockey stick of claim 19, wherein the attachment comprises a core and the attachment members project from the core towards the internal surface.

22. The hockey stick of claim 21, wherein the core tapers in a longitudinal direction of the end cap.

23. The hockey stick of claim 22, wherein the core tapers in the longitudinal direction of the end cap away from the end portion.

24. The hockey stick of claim 9, wherein a cross-section of the end portion normal to a longitudinal direction of the end cap is larger than a cross-section of the hanging portion normal to the longitudinal direction of the end cap.

25. The hockey stick of claim 9, wherein a cross-section of the end portion normal to a longitudinal direction of the end cap is larger than a cross-section of the shaft normal to a longitudinal direction of the shaft.

26. The hockey stick of claim 9, wherein the end cap comprises a base and the hanger is movable relative to the base to adjust the hanger.

27. The hockey stick of claim 26, wherein the hanger is movable relative to the base in a longitudinal direction of the end cap.

28. The hockey stick of claim 26, wherein the hanger is movable relative to the base between a first position in which the hockey stick is hangable by the hanger and a second position in which the hockey stick is not hangable by the hanger.

29. The hockey stick of claim 28, wherein the hanger is exposed in the first position and concealed in the second position.

30. The hockey stick of claim 28, wherein the base comprises a cavity and the hanger extends deeper into the cavity when the hanger is in the second position than when the hanger is in the first position.

31. The hockey stick of claim 9, wherein the end cap is a one-piece end cap.

32. The hockey stick of claim 31, wherein the one-piece end cap is a molded one-piece end cap.

33. The hockey stick of claim 32, wherein the molded one-piece end cap is an injection-molded one-piece end cap.

* * * * *